United States Patent [19]

Gendron et al.

[11] 4,154,307

[45] May 15, 1979

[54] PILE DRIVING SYSTEM

[75] Inventors: George J. Gendron; H. A. Nelson Holland, both of Houston, Tex.

[73] Assignee: Raymond International, Inc., Houston, Tex.

[21] Appl. No.: 743,327

[22] Filed: Nov. 19, 1976

[51] Int. Cl.[2] ..... E21C 11/02

[52] U.S. Cl. ..... 173/21; 173/88; 405/232

[58] Field of Search ..... 173/21, 13, 88, 127, 173/43, 81, 137; 61/53.5; 175/10, 135

[56] References Cited

U.S. PATENT DOCUMENTS

| | | | |
|---|---|---|---|
| 1,908,217 | 5/1933 | Blumenthal | 61/53.5 |
| 2,521,976 | 9/1950 | Hays | 173/21 |
| 2,723,532 | 11/1955 | Smith | 61/53.5 |
| 3,367,426 | 2/1968 | Laverty | 173/21 |
| 3,604,522 | 9/1971 | Doughty | 173/88 |
| 3,817,335 | 6/1974 | Chelminski | 173/127 |

*Primary Examiner*—C. J. Husar

*Attorney, Agent, or Firm*—Arnold, White & Durkee

[57] ABSTRACT

A pile driving system for driving piles into an underwater surface which comprises an elongated two-part housing having a casing disposed within the lower portion of the housing and movable with respect to the housing. The casing has a pile driving hammer assembly disposed within the casing and the casing is independently suspended within the lower portion of the housing whereby the hammer assembly may be engaged with the pile and impart a series of blows to the pile, while the housing remains substantially stationary with respect to the underwater surface.

20 Claims, 12 Drawing Figures

FIG. 4
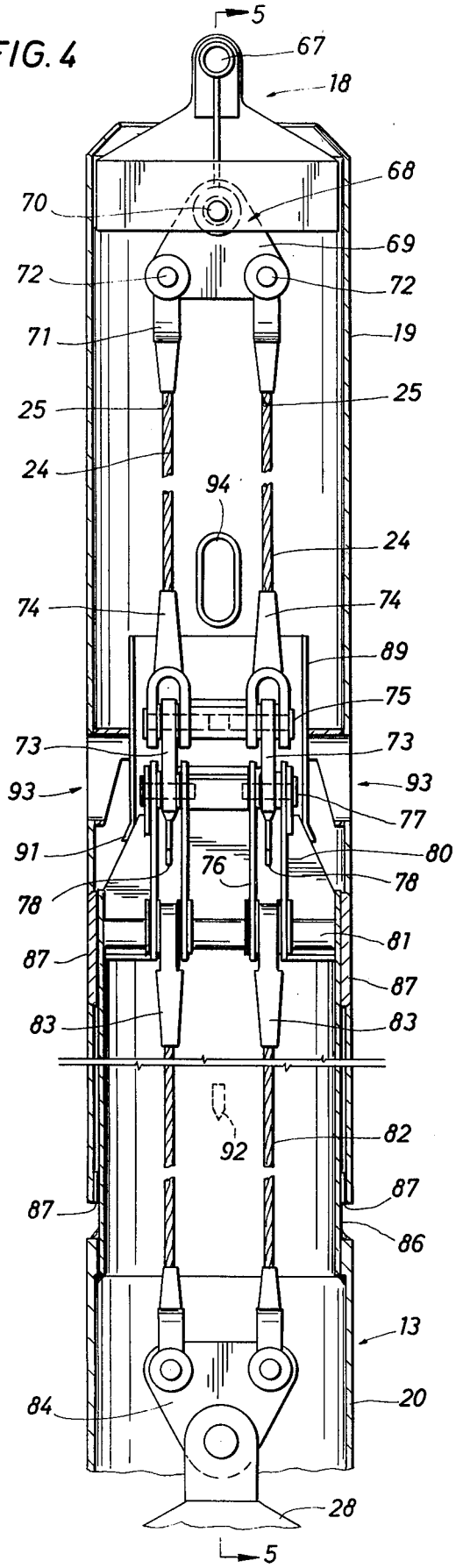
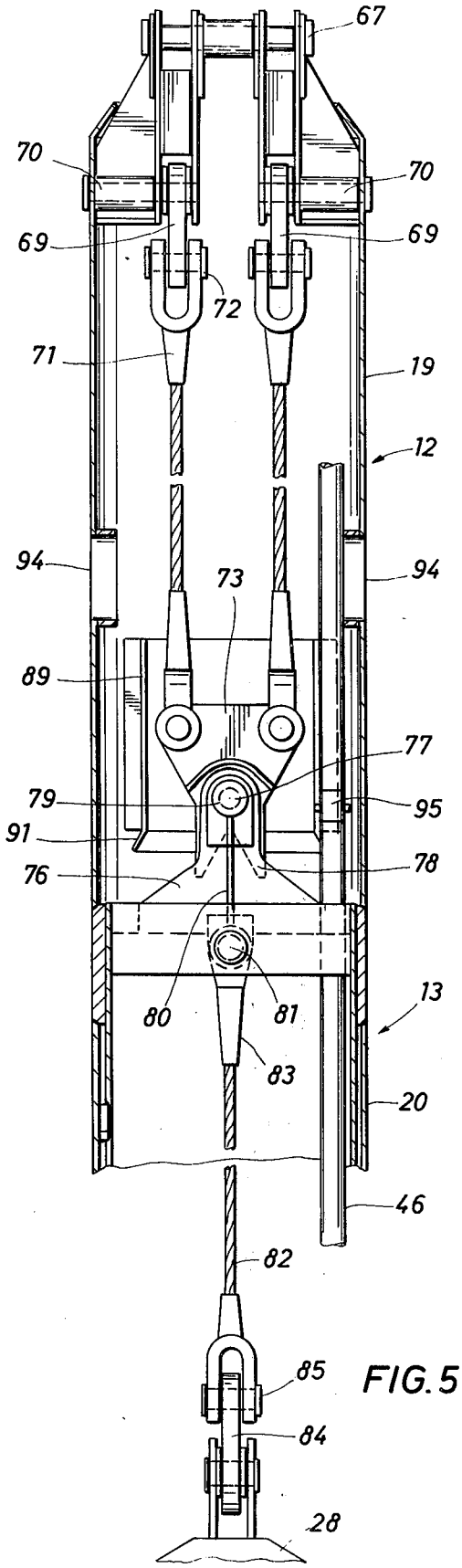
FIG. 5

PILE DRIVING SYSTEM

IDENTIFICATION OF RELATED APPLICATIONS

This application is related in subject matter to copending U.S. patent application Ser. No. 743,227, entitled "Method of Driving Piles Underwater" filed on even date herewith in the names of George J. Gendron and Lindsey J. Phares and commonly assigned with this application.

BACKGROUND OF THE INVENTION

1. Field of the Invention

The present invention relates to a pile driving system for driving piles into an underwater surface; and more particularly, the present invention relates to a pile driving system capable of being used in great depths of water.

2. Description of the Prior Art

In the installation of an offshore structure, such as a drilling or production platform, it is the general practice to secure the structure in some manner to the underwater surface to prevent overturning of the structure. A conventional technique for securing the offshore structure to the ocean floor is the driving of elongated piles into the underwater surface. Typically, an offshore structure will have several legs to support the structure, with one or more piles being provided at each leg depending upon the type of soil into which the piles are to be driven. Generally, piles will be carried in pile sleeves attached to the outside of the support legs, or will be lowered through the interior of the hollow support legs until the piles contact the underwater surface. Examples of the foregoing techniques are found in U.S. Pat. No. 3,751,930, issued Aug. 14, 1973, to Mott et al., and U.S. Pat. No. 3,604,522, issued Sept. 14, 1971, to Doughty, respectively.

Many pile driving hammers have been proposed in the past. These proposed hammers fall into two basic categories: those which are operated above the water surface and those operated fully underwater. Examples of the former category are shown in the Mott et al. patent and U.S. Pat. No. 3,289,420, issued Dec. 6, 1966, to Guy. Examples of the latter category are described in U.S. Pat. Nos. 3,646,598, issued Feb. 29, 1972, to Chelminski; 3,750,609, issued Aug. 7, 1973, to Chelminski; 3,842,917, issued Oct. 22, 1974, to Wisotsky; 3,817,335, issued June 18, 1974, to Chelminski; 3,846,991, issued Nov. 12, 1974, to Wisotsky; and the Doughty patent. Another underwater hammer is the HYDROBLOCK ™, manufactured by Hollandsche Beton Maatschappij bv of the Netherlands.

Those hammers which operate above the water surface are typically of conventional construction, wherein either compressed air or steam provides the motive force which causes the hammer to deliver repetitive blows to the pile. A distinct disadvantage in employing hammers of this type is the necessity of utilizing pile followers in order to transmit the forces from the hammer to the top of the pile. A pile follower is an extension that is attached to the top of the pile and the pile follower is struck by the hammer. Particularly when driving piles in great depths of water, a plurality of these followers are necessary. Followers have several disadvantages, in that they are extremely heavy, expensive, and believed to introduce inefficiency into the pile driving system because of energy losses associated with transmitting the hammer's blow through the follower to the upper end of the pile. Additionally, the utilization of a plurality of pile followers results in a substantial amount of time wasted while the followers are brought into place and connected to the previous follower. In many locations throughout the world, weather conditions are such that pile driving operations cannot be accomplished throughout the year, but only during certain portions of the year when the ocean is relatively calm and fair skies prevail. Accordingly, if the offshore structure cannot be secured to the underwater surface during which time the weather conditions are favorable, the offshore structure must remain idle until such time as better weather conditions prevail. Since these offshore structures are most typically used to facilitate the drilling of offshore oil wells, the time delays result in lost crude oil, or natural gas, production, along with the risks attendant in not having the offshore structure fully secured to the underwater surface.

Another disadvantage inherent in utilizing a plurality of pile followers is that fairly large derrick barges must be used in the pile driving operation to support the hammer and the pile followers during the pile driving operation and while connecting the pile followers. Furthermore, additional costs are associated with the pile driving operation since, in addition to the initial cost of the pile followers, there are costs associated with transporting and storing them until their use is necessitated.

Accordingly, these disadvantages prompted the introduction of pile driving hammers which are operated while being fully underwater, whereby the hammer could directly contact the pile and eliminate the utilization of the followers. The previously proposed underwater hammers still present many disadvantages which militate against, and indeed even prevent, their use in deep water offshore pile driving operations.

Generally, these underwater pile driving hammers lack any means for positioning the hammer above the pile which is to be driven into the underwater surface; e.g., the hammers shown in the Wisotsky patents and the U.S. Pat. No. 3,750,609 to Chelminski, and the HYDROBLOK ™ hammer. In the case of the Chelminski U.S. Pat. No. 3,750,609, the hammer is mated with an anchor to form a unit, and this unit is merely lowered into the water until the underwater surface is reached. It is believed that this hammer system could not be utilized in operations wherein precise locating of the anchor is necessary. The Wisotsky patents disclose underwater hammers which, it is believed, could not be utilized for driving piles in the great depths of water prevalent at many offshore locations, since no means is provided for guiding the hammer into accurate alignment with a prepositioned pile which is already located at the underwater surface. It would appear that these hammers could only be utilized in situations wherein after the pile has been placed in contact with the underwater surface, the top of the pile either extends above the water surface, or is disposed a short distance below the water surface, such that an operator disposed upon a derrick barge could visually guide the hammer into engagement with the pile, or divers disposed in the water could guide the hammer into engagement with the top of the pile.

Although the HYDROBLOK ™ hammer has a sleeve at its base for engaging the top of a pile, there is no means provided for guiding the HYDROBLOK ™ hammer into engagement with the top of a pile which may be located many hundreds of feet below the water surface. Additionally, the HYDROBLOK ™ hammer employs a ram and hydraulic power unit contained in a casing which is purged of water by air pressure. The casing must be provided with sufficient ballast to counteract the buoyancy of the casing. Accordingly, although this hammer is adapted for underwater operations, it is thought to be only used above the water in conjunction with conventional pile followers or used in very shallow depths of water wherein divers may position the hammer upon the top of a pile.

The Chelminski U.S. Pat. Nos. 3,817,335 and 3,646,598 disclose underwater hammers which are employed within the interior of hollow piles, whereby the pile itself guides the hammer into a position whereby the pile may be driven into the underwater surface. The major disadvantage of this approach is that the overall length of the pile must closely approximate the distance between the water surface and the underwater surface, whereby the hammer will be guided into a pile driving relationship with respect to the interior of the hollow pile. Accordingly, in deep water operations these hammers cannot be readily utilized unless a plurality of hollow piles are welded together to form a continuous guide for the hammer, and this approach inherently has the disadvantages which are present when utilizing conventional pile followers.

The Doughty hammer is similar to the Chelminski U.S. Pat. Nos. 3,817,335 and 3,646,598, in that it relies upon the inner surface of a hollow support leg of the offshore structure to guide it into engagement with the top of the pile to be driven into the underwater surface. Were this hammer to be utilized to drive a pile disposed along the lower, outer surface of a support leg of an offshore structure, it would encounter the same difficulties of previously described hammer systems, in that it could not be accurately aligned to engage the top of the pile. Another disadvantage and potential hazard to the system proposed by Doughty results from its construction. The Doughty system utilizes a casing having an integral anvil at its lower end. As a ram, which is contained within the casing, repeatedly strikes the anvil, the casing will be continually pulled into tension. It is believed that the casing will fracture, thus causing the anvil to separate from the casing.

Accordingly, prior to the development of the present invention, there has been no pile driving system for driving piles into an underwater surface, particularly underwater surfaces disposed at great depths, which is capable of being easily and inexpensively brought into engagement with the top of the pile whereby the offshore structure can be quickly secured to the underwater surface. Therefore, the art has sought a pile driving system for driving piles into an underwater surface which easily and inexpensively drives the piles into the underwater surface, absent the problems of previously proposed hammer systems and without the necessity of pile followers.

SUMMARY OF THE INVENTION

In accordance with the invention, the foregoing has been achieved through the present pile driving system for driving piles into an underwater surface.

The present invention includes a pile driving system for driving piles into an underwater surface, which comprises an elongated housing having an upper and lower portion, the lower portion having an open botton for allowing water to enter the interior of the housing, the housing adapted to be suspended underwater and disposed substantially perpendicular to, and spaced from, the underwater surface; and an elongated casing disposed within the lower portion of the housing and movable with respect to the housing along a path parallel to the longitudinal axis of the housing. The casing has associated therewith a pile driving hammer assembly. A portion of the hammer assembly is adapted for engagement with a pile which is to be driven into the underwater surface, and the housing is adapted for guiding the casing and hammer assembly into engagement with the pile.

In one embodiment of the present invention, the portion of the hammer assembly, which is adapted to engage the pile, extends through and beyond the open bottom of the housing, and that portion of the hammer assembly is a driving head. The driving head includes means for operatively connecting it to another portion of the hammer assembly and includes shock absorber means.

As indicated above, in more specific terms, the pile driving assembly comprises an elongated ram, which includes a lower section, slidably disposed within the casing and movable along a reciprocating path parallel to the longitudinal axis of the casing; an anvil disposed within the casing and having an upper portion and a lower portion, the upper portion adapted for operative engagement with the ram and the lower portion operatively connected to a driving head; and a power source associated with the anvil for causing the ram to move along its reciprocating path into operative engagement with the upper portion of the anvil, whereby a plurality of blows may be imparted to the driving head.

In one embodiment of the present invention, the power source is an air gun which is disposed within the anvil and is adapted to provide a first blow to the lower portion of the anvil and then cause the ram to move along its reciprocating path, whereby a second blow is imparted to the upper portion of the anvil. The operative connection between the lower portion of the anvil and the driving head may include shock absorber means. The operative connection may be comprised of a plurality of bolts which pass through the lower portion of the anvil and extend into the pile follower. The shock absorber means may be comprised of a body of resilient material which is spaced apart from the anvil, disposed about the bolts, and is in contact with the driving head.

In another aspect of the present invention, a sleeve is mounted within the casing. The sleeve has its outer surface fixedly secured to the interior of the casing and has its inner surface in sliding contact with the upper portion of the anvil and the lower section of the ram. The sleeve is adapted to guide the ram into operative engagement with the upper portion of the anvil and to assist the upper portion of the anvil in confining the air, discharged from the air gun, between the upper portion of the anvil and the lower section of the ram. A shock absorber means may be disposed between the sleeve and the upper portion of the anvil, and the shock absorber means is comprised of a plurality of resilient compression rings disposed about the outer surface of the upper portion of the anvil.

As indicated above, in more specific terms, the housing includes means for independently suspending the casing and its associated pile driving assembly within the lower portion of the housing, whereby the hammer assembly may be engaged with the pile and impart a series of blows to the pile, while the housing remains substantially stationary with respect to the underwater surface. The means for independently suspending the casing may comprise a retaining means fixedly associated with the housing and a connector means disposed between the retaining means and the casing. The retaining means may comprise at least one equalizer plate fixedly associated within the housing and the connector means may comprise at least one cable having an upper end attached to the equalizer plate and a lower end attached to the casing.

In another aspect of the present invention, the upper portion of the housing may comprise an upper housing and the lower portion may comprise a lower housing. One of said housings may include a telescopic connection means, whereby one of the housings is telescopically received within the other housing.

In one embodiment of the present invention, the lower housing may be telescopically received within the upper housing. The upper housing may include means for suspending the lower housing which may be comprised of at least one cable, having an upper end attached to the upper housing and a lower end attached to the lower housing. The means for independently suspending the casing within the lower portion of the lower housing may comprise a retaining means fixedly associated with the lower housing and a connector means disposed between the retaining means and the casing. The retaining means may comprise at least one equalizer plate fixedly associated with the lower housing and the connector means may comprise at least one cable, having an upper end attached to the equalizer plate and a lower end attached to the casing.

In one embodiment of the present invention, the telescopic connection means may comprise a receptacle fixedly secured within the upper housing, a portion of the lower housing being guidingly received within the receptacle, and at least one opening extending through the upper housing and the receptacle, whereby access is provided to the interior of the receptacle to facilitate connecting the upper and lower housings.

In another aspect of the present invention, the pile driving system includes a locating means for indicating the position of the casing relative to the housing. The locating means may include a tag line assembly comprised of a line, having a lower end attached to the casing and an upper end attached to an indicator bar. The indicator bar may be slidably received within a sleeve, whereby as the housing moves relative to the casing, the indicator bar will move relative to the sleeve to indicate the position of the casing relative to the housing.

The pile driving system of the present invention, when compared with previously proposed prior art hammer systems, has the advantages of: efficiency in driving piles; elimination of the use of conventional pile followers; economical to operate, in addition to the cost savings in being able to drive piles without using conventional pile followers or requiring a hollow pile which spans the distance from the water surface to the underwater surface; and provides a pile driving system which may be operated within, or along the outer surface of, a support leg of an offshore structure.

BRIEF DESCRIPTION OF THE DRAWINGS

In the accompanying drawings:

FIG. 4 is a cross sectional view taken along line 4—4 in FIGS. 1A and 1B;

FIG. 5 is a cross sectional view taken along lines 5—5 in FIG. 4;

While the invention will be described in connection with the preferred embodiment, it will be understood that it is not intended to limit the invention to that embodiment. On the contrary, it is intended to cover all alternatives, modifications, and equivalents as may be included within the spirit and scope of the invention as defined by the appended claims.

DETAILED DESCRIPTION OF THE INVENTION

Figure 1A:
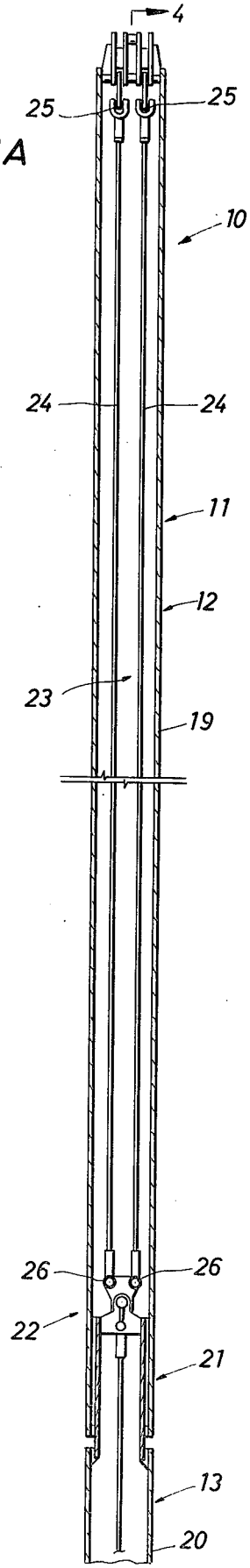
FIGS. 1A and 1B are partial cross sectional views of a pile driving system in accordance with the present invention.
Figure 1B:
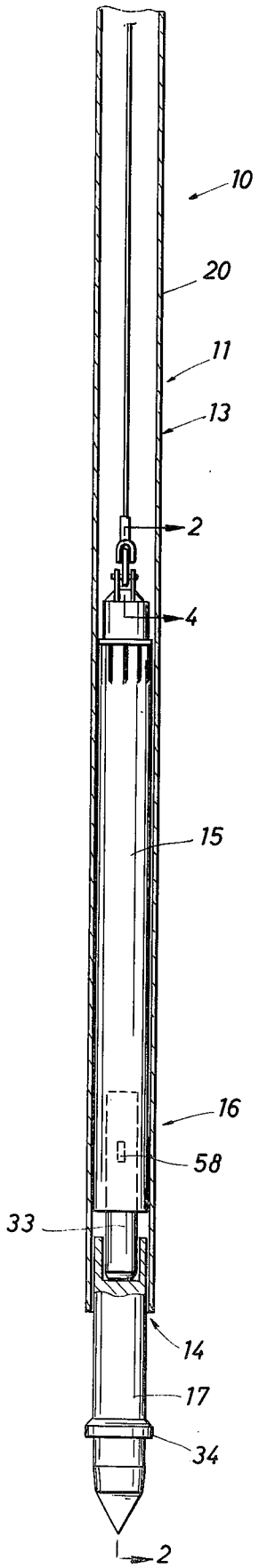

Referring now to FIGS. 1A and 1B a pile driving system 10, in accordance with the present invention is shown. FIG. 1B is a continuation of the lower portion of FIG. 1A. The pile driving system 10 is broadly comprised of an elongated housing 11 which has an upper portion 12 and a lower portion 13. The lower portion 13 has an open bottom 14 as shown in FIG. 1B. Still referring to FIG. 1B, an elongated casing 15 is disposed within the lower portion 13 of housing 11. Casing 15 is movable with respect to housing 11, along a path parallel to the longitudinal axis of the housing 11 as will be hereinafter described.

Casing 15 has associated therewith a pile driving hammer assembly 16, a portion of which is shown toward the bottom of FIG. 1B and which will be hereinafter described. A portion of the hammer assembly, or driving head 17, extends through and beyond the open bottom 14 of housing 11, and is adapted to engage a pile (not shown) which is to be driven into an underwater surface.

The housing 11 is adapted to be suspended underwater and disposed substantially perpendicular to, and spaced from an underwater surface. To this end, the upper portion 12 of housing 11 is provided with a lifting bail 18, which will be hereinafter described. Housing 11 may be suspended by means of a cable (not shown) which is attached to bail 18, whereupon housing 11 will guide casing 15 and its associated hammer assembly 16 into engagement with the pile which is to be driven into an underwater surface. Preferably, system 10 will be brought into engagement with the pile in accordance with the method disclosed in the co-pending U.S. patent application Ser. No. 743,227, of George J. Gendron and Lindsey J. Phares. In that application, a method of driving a pile into an underwater surface is disclosed, wherein a pile is disposed underwater in guide sleeves secured at spaced locations along the exterior of a member that extends down to the underwater surface. A housing having a pile driving hammer mounted inside it is lowered through the guide sleeves and into contact with the pile, whereupon the hammer delivers a succession of blows to the pile to drive the pile into the underwater surface. Although the method disclosed in that application is preferred, the pile driving system of the present invention may be utilized in other methods, e.g., the pile driving system 10 of the present invention could be lowered through a hollow support leg of an offshore structure until hammer assembly 16 is brought into engagement with the pile which is to be driven into the underwater surface.

Preferably, upper portion 12 of housing 11 and lower portion 13 of housing 11 are each comprised of a separate housing: upper housing 19 and lower housing 20, each housing being on the order of approximately 100 feet in length, whereby the total length of housing 11 is approximately 200 feet. Of course, it should be readily apparent that housing 11 could be one integral housing, approximately 200 feet in length, but two separate housings 19 and 20 are preferred for ease of handling at the offshore location.

Still referring to FIGS. 1A and 1B, it is seen that upper housing 19 is provided with a telescopic connection means, generally shown at 21 in FIG. 1A, whereby one of the housings is telescopically received within the other housing. Preferably, lower housing 20 is telescopically received within upper housing 19, although it should be readily apparent that the telescopic connection means 21 could be reversed whereby upper housing 19 is telescopically received within lower housing 20. Telescopic connection means 21 will be described hereinafter in more detail with reference to FIGS. 4 and 5.

Housing 11, casing 15, hammer assembly 16, and all other related structures to be hereinafter described, which comprise pile driving system 10 are manufactured from any suitable material having the requisite strength and corrosion resistant qualities necessary to enable operation of the pile driving system 10 in an underwater environment and which is able to withstand the stresses and strains exerted upon system 10 during a pile driving operation conducted underwater. Such suitable materials include a large number of steels readily known to those of ordinary skill in this art.

Housing 11 includes means for independently suspending casing 15 and its associated pile driving assembly 16 within the key lower portion 13 of housing 11. This independent suspension means shown generally at 22 in FIG. 1A will be hereinafter described in more detail with reference to FIGS. 4 and 5. The suspension means 22 enables casing 15 and hammer assembly 16 to be engaged with a pile and impart a series of blows to the pile, while housing 11 remains substantially stationary with respect to the underwater surface, as will be hereinafter described in more detail.

Upper housing 19 includes means for suspending lower housing 20, which suspension means 23 is comprised of at least one cable. As shown in FIG. 1A, suspension means 23 includes four cables 24, each cable 24 having an upper end 25 attached to upper housing 19 and a lower end 26 attached to the lower housing 20. Suspension means 23 will be hereinafter described in more detail, particularly with reference to FIGS. 4 and 5.

Figure 2A:
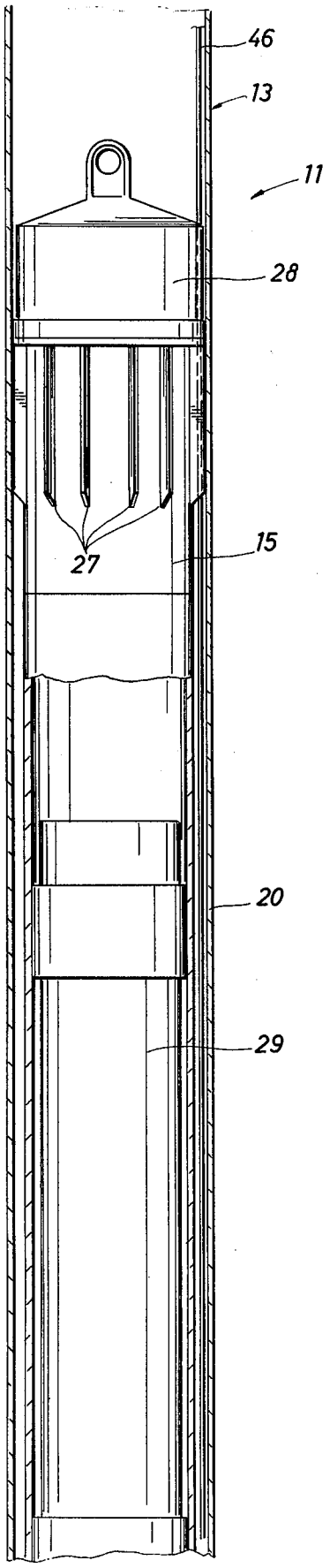
FIGS. 2A and 2B are partial cross sectional views taken along line 2—2 of FIG. 1B.
Figure 2B:
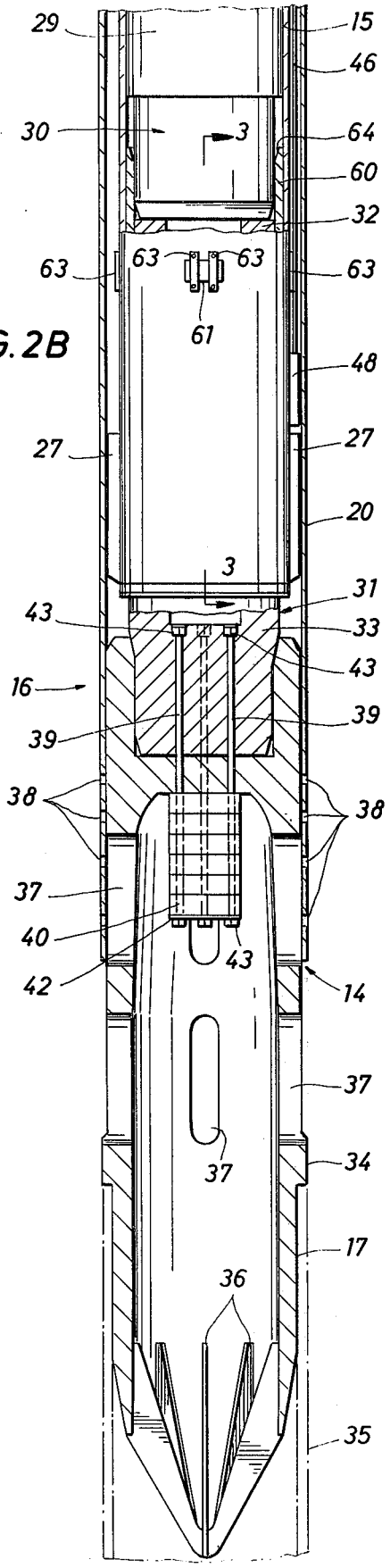

Turning now to FIGS. 2A and 2B, the preferred casing 15 and hammer assembly 16 will be described. As shown in FIG. 2A, the lower portion 13 of housing 11, or lower housing 20 has disposed within it casing 15. Casing 15, as is housing 11, is preferably of a generally cylindrical configuration. Of course, casing 15 could have other configurations, provided it is substantially the same configuration as housing 11; e.g., square, triangular, rectangular, or oval configuration. As shown in FIGS. 2A and 2B, casing 15 is provided with a plurality of vanes 27 disposed at its upper and lower ends for centering casing 15 within housing 11. Vanes 27 may be provided with a suitable bearing wear surface to insure that casing 15 will be so centered. The top of casing 15 is provided with a lifting bail 28 by which casing 15 is suspended within housing 11.

Still referring to FIGS. 2A and 2B, it is seen that an elongated ram 29, which includes a lower section generally shown at 30 in FIG. 2B is slidably disposed within casing 15 and is movable along a reciprocating path parallel to the longitudinal axis of casing 15. Elongated ram 29 forms one element of the pile driving hammer assembly 16 and cooperates with the anvil element of hammer assembly 16 as shown in FIG. 2B and, in more detail, in FIG. 3.

Figure 3:
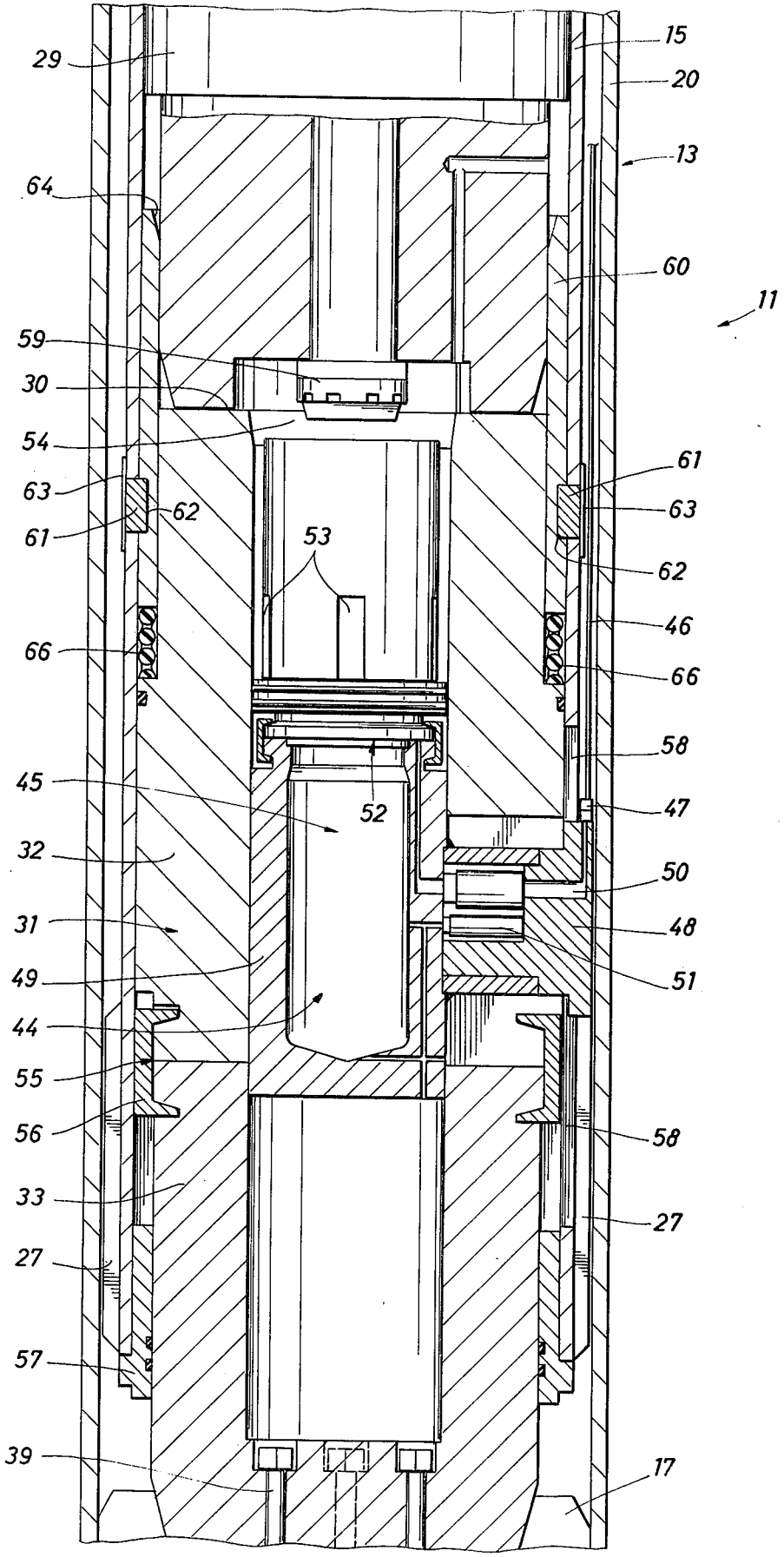
FIG. 3 is a cross sectional view taken along line 3—3 of FIG. 2B.

Referring now to FIGS. 2B and 3, it is seen that hammer assembly 16 includes an anvil, generally shown at 31 in FIG. 3, which has an upper portion 32 and a lower portion 33. Part of upper portion 32 and lower portion 33 are likewise shown in FIG. 2B. Upper portion 32 of anvil 31 is adapted for operative engagement with ram 29 and lower portion 33 of anvil 31 is operatively connected to driving head 17, as shown in FIG. 2B. Driving head 17 is adapted for engagement with the pile which is to be driven into the underwater surface. Driving head 17 is provided with a raised rib 34 along its outer surface, which is adapted to abut the upper surface of a hollow pile 35 as shown in phantom lines in FIG. 2B. It should be readily apparent that other configurations of driving heads could be utilized when driving piles having different configurations, e.g., if solid piles are being driven, driving head 17 could be provided with a solid end having a depending lip adapted to surround the outer surface of the pile. Preferably, driving head 17 may be provided with a plurality of reinforcing ribs 36 disposed within the interior of driving head 17 as shown in FIG. 2B.

As shown in FIG. 2B, driving head 17 extends through and beyond the open bottom 14 of housing 11 and is slidably movable with respect to the interior of housing 11. Driving head 17 is preferably provided with a plurality of vents 37 for venting water, contained within pile 35, as driving head 17 imparts a blow to pile 35 thus causing that water to flow outwardly of pile 35. Similarly, the lower portion 13 of housing 11 is provided with a plurality of vent holes 38 which likewise serve to vent the water flowing outwardly from pile 35.

Still referring to FIG. 2B, it is seen that driving head 17 is operatively connected to the lower portion 33 of anvil 31 by means of a plurality of bolts 39 which pass through the lower portion 33 of anvil 31 and extend into driving head 17. A shock absorber means 40, comprised of a body of resilient material, is spaced apart from anvil 31, and is disposed about the bolts 39 in contact with driving head 17. Shock absorber means 40 is preferably comprised of a plurality of cylindrical cushions 41 which are disposed in the interior of driving head 17. A retainer plate 42 is disposed against the outer cushion of the shock absorber means and a plurality of nuts 43 engage the ends of bolts 39 and abut against retainer plate 42 and the lower portion 33 of anvil 31. Shock absorber means 40 serves to insure that, as anvil 31 strikes driving head 17 to impart a blow to pile 35, bolts 39 will not be pulled into excessive tension, whereby they might be subject to fracturing and causing driving head 17 to separate from anvil 31.

Referring now to FIG. 3, the power source 44 of hammer assembly 16 will be described. Power source 44 is associated with anvil 31 and serves to cause ram 29 to move along its reciprocating path parallel to longitudinal axis of casing 15, whereby ram 29 is brought into operative engagement with the upper portion 32 of anvil 31 whereby a plurality of blows may be imparted to driving head 17 via anvil 31.

Although any suitable power source may be employed to impart the reciprocating motion to ram 29, the utilization of an air gun 45 is preferred for power source 44. Air gun 45 is similar in some respects to that shown in U.S. Pat. No. 3,817,335, issued June 18, 1974, to Chelminski, in that air gun 45 abruptly releases a charge of very high pressure gas, such as compressed air, each time the air gun 45 is repetitively actuated, or fired. As air gun 45 is fired, it exerts a first blow, or force, upon the lower portion 33 of anvil 31, which in turn transmits a pile driving blow to the pile via driving head 17. This first blow is caused by the abrupt discharge of the pressurized air through outlets 46 of air gun 45. The pressurized gas, or air, necessary for the operation of air gun 45 is provided through a high pressure air line 46 which is disposed in the space between casing 15 and housing 11 as shown in FIGS. 2B and 3. A suitable source of pressurized gas (not shown) is provided on the offshore structure and is associated with air line 46. As shown in FIG. 2A, lifting bail 28 is provided with a suitably sized keyway whereby air line 46 passes through lifting bail 28 without obstruction. Returning to FIG. 3, it is seen that air line 46 is connected to air gun 45 by means of a suitable connection 47 which connects air line 46 to an air gun bumper 48 associated with air gun 45. Bumper 48 is fixedly secured to the air gun firing chamber 49, and includes a passageway 50 leading from connection 47 to air gun firing chamber 49. Bumper 48 additionally includes an air gun purge line 51 which enables firing chamber 49 to be purged of any water present therein prior to the firing of air gun 45. Purge line 51 passes through bumper 48 and is connected to a hose (not shown) similar to air line hose 46. As the pressurized gas, or air, flows into the spaced defined by air gun firing chamber 49 it is confined therein, until a suitable valve, shown generally at 52, is open whereby the pressurized gas is abruptly released through openings 53 into an air gun discharge chamber 54 which is defined by the inner surface of the upper portion 42 of anvil 31 and the lower section 30 of ram 29.

Still referring to FIG. 3, it is seen that air gun 45 is disposed within anvil 31, specifically between the upper portion 32 and the lower portion 33 of anvil 31. The upper portion 32 and lower portion 33 of anvil 31 abut one another, as shown generally at 55 and are joined by a cylindrical clamp ring 56.

Again referring to FIG. 3, a cylindrical closure bearing ring 57 is provided along the lower end of casing 15 and is fixedly secured thereto by means of bolts (not shown) and bearing ring 57 is in sliding contact with the lower portion 33 of an anvil 31.

Casing 15 is provided with a gun aperture 58, or opening as shown in FIGS. 1B and 3 through which bumper 48 protrudes slightly. Accordingly, as air gun 45 is fired and the pressurized gas is abruptly released through openings 53 into air gun discharge chamber 54, air gun 45, bumper 48, and anvil 31 will move downward toward driving member 17, whereupon a first blow, as previously discussed, will be imparted to the pile via driving head 17. Since bumper 48 has this slight reciprocating motion, high pressure air line 46 is provided with a suitable amount of slack to compensate for this movement.

As the high pressure gas is expelled through openings 46 into discharge chamber 54, this rapidly expanding gas exerts a force upon the lower section 30 of ram 29, whereupon ram 29 is caused to move upwardly and away from upper portion 32 of anvil 31. The lower section 30 of ram 29 is provided with a suitable valve 59 which is closed in response to the forces exerted by the expanding gas in discharge chamber 54. As the confined expanding gas is dissipated and escapes from casing 15, the force of gravity and the weight of the water above the upper end of ram 29, cause ram 29 to move downwardly to impart a second blow to the upper portion 32 of anvil 31, which blow is in turn transmitted to the driving head 17 by the lower portion 33 of anvil 31. After ram 29 has struck anvil 31, valve 59 opens, whereupon water flows into discharge chamber 54, and the air gun is ready to be fired again. Suitable controls (not shown) are provided for operation of air gun 45, e.g., an electrical control cable associated with air line 46 may be disposed between air gun 45 and an operators control booth (not shown) on the offshore structure, or a pressure-responsive release valve (not shown) may be associated with air line 46 to make air gun 45 self-operating. Both methods of controlling air gun 45 are discussed in U.S. Pat. No. 3,817,335.

Referring now to FIGS. 2B and 3, a sleeve 60 is shown to be mounted within casing 15. The outer surface of cylindrical sleeve 60 is fixedly secured to the interior of casing 15 by means of a plurality of retainer blocks 61 which engage an indentation 62 in the outer surface of sleeve 60. Suitable retainer bars 63 securely urge retainer blocks 61 into indentations 62. The inner surface of sleeve 60 is in sliding contact with the upper portion 32 of anvil 31 and the lower section 30 of ram 29, as shown in FIG. 3. Sleeve 60 may be provided with a beveled edge 64 adapted to guide ram 29 into operative engagement with the upper portion 32 of anvil 31. Additionally, sleeve 60 serves to assist the discharge chamber 54 in the upper portion 32 of anvil 31 in confining the released pressurized, expanding air, discharged from air gun 45, between the upper portion 32 of anvil 31 and the lower section 30 of ram 29, as the ram starts to move upwardly away from anvil 31.

Preferably, a shock absorber means 65 is disposed between sleeve 60 and the upper portion 32 of anvil 31. Shock absorber means 65 may be comprised of a plurality of resilient compression rings 66 disposed about the outer surface of the upper portion 32 of anvil 31. As the driving head rebounds from the pile after it imparts a blow to the pile, thus forcing anvil 31 and air gun 45 to move upwardly, shock absorber means 65 serves to absorb the shock of that movement.

Turning now to FIGS. 4 and 5, the details of the suspension system for housing 11 and casing 15 will be described. As will be hereinafter described, housing 11 includes a means for independently suspending the casing 15 and its associated pile driving hammer assembly 16 within the lower portion 13 of housing 11. As shown in FIGS. 4 and 5 upper housing 19 has a lifting bail 18 comprised of a lifting shaft 67 fixedly secured at its upper end and adapted to be engaged with a suitable cable (not shown) which is adapted to be lifted or lowered from a suitable winch or crane apparatus (not shown) disposed upon an offshore structure (not shown), whereby housing 11 may be lowered into the water to guide casing 15 and its associated hammer assembly 16 into engagement with a pile disposed at the underwater surface. Lifting bail is provided with suitable openings for allowing air to be vented from the interior of housing 11. Located below lifting shaft 67 is a retaining means 68 fixedly associated with upper housing 19. Preferably, retaining means 68 is comprised of at least one equalizer plate 69. Preferably as shown in FIGS. 4 and 5 two equalizer plates 69 are utilized as retaining means 68, but, of course, is readily apparent that any number of retaining plates 69 could be utilized depending upon the number of cables which are suspended therefrom. Were only one cable to be suspended from retaining means 68, a rectangular shaped equalizer plate 69 could be utilized, or, alternatively, the single cable being utilized could be directly attached to the shaft 70 upon which equalizer plates 69 are mounted. Shafts 70 are fixedly secured within upper housing 19.

A connector means, or cables 24 are suspended from equalizer plates 69 and are suitably attached to equalizer plates 69 via brackets 71 and pins 72.

The lower ends of the four cables 24 are similarly attached to equalizer plates 73 via brackets 74 and pins 75. Equalizer plates 73 are similarly fixedly associated with lower housing 20 by means of brackets 76 and pins 77. Equalizer plates 73 have depending members 78 which form a V-shaped notch whereby equalizer plates 73 are guided into alignment with the openings 79 and brackets 76 which accommodate pins 77. The V-shaped notches formed by depending members 78 engage reinforcing members 80 which are fixedly secured to the top of lower housing 20, whereby equalizer plates 73 are guided into alignment with the openings 79 in brackets 76 which accommodate pins 77. Depending from brackets 76 are shafts 81 which have the upper ends of connector means, or cables 82 mounted thereon by means of brackets 83. The lower ends of connector means, or the two cables 82, are attached to the lifting bail 28 of casing 15 by means of equalizer plates 8 and pins 85.

Figure 8:
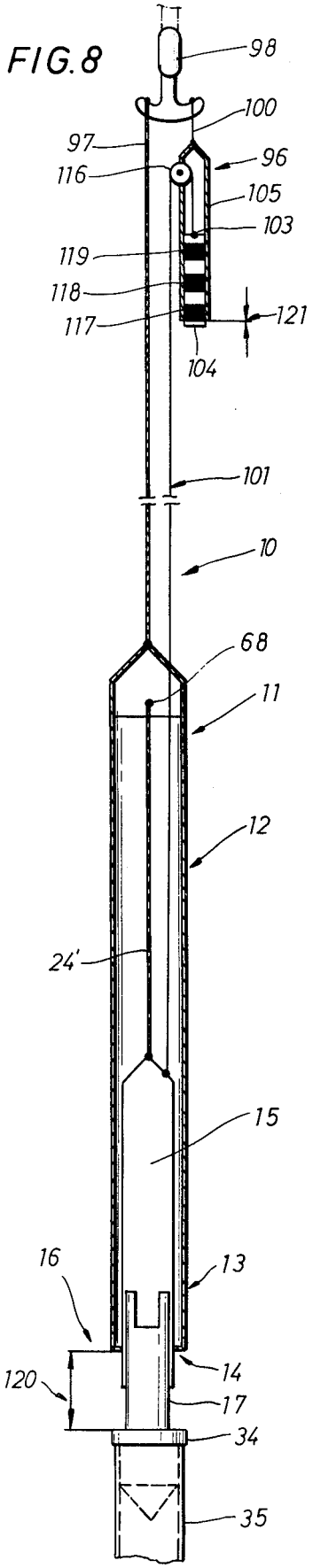
FIGS. 8–10 are partial schematic cross sectional views of a pile driving system in accordance with the present invention illustrating the manner in which the casing is independently suspended within the housing and the operation of the tag line assembly.
Figure 9:
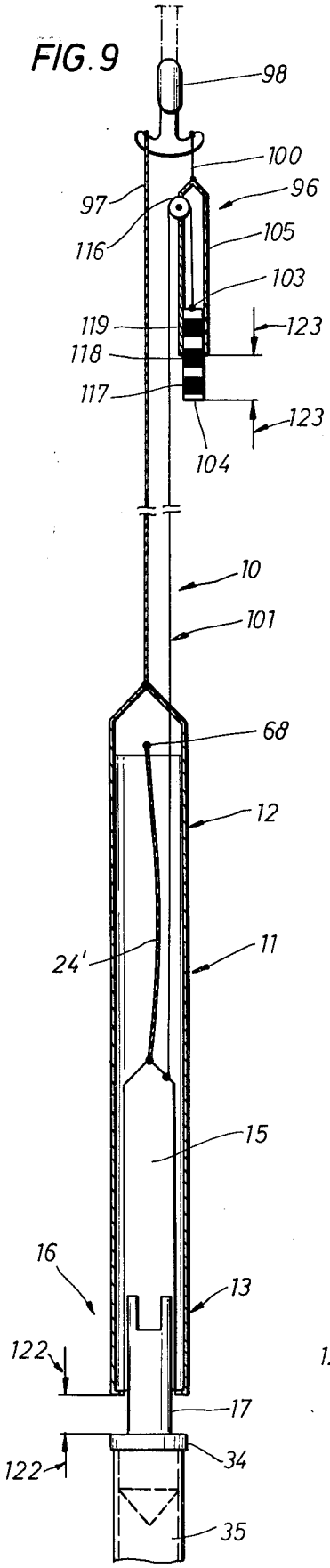
Figure 10:
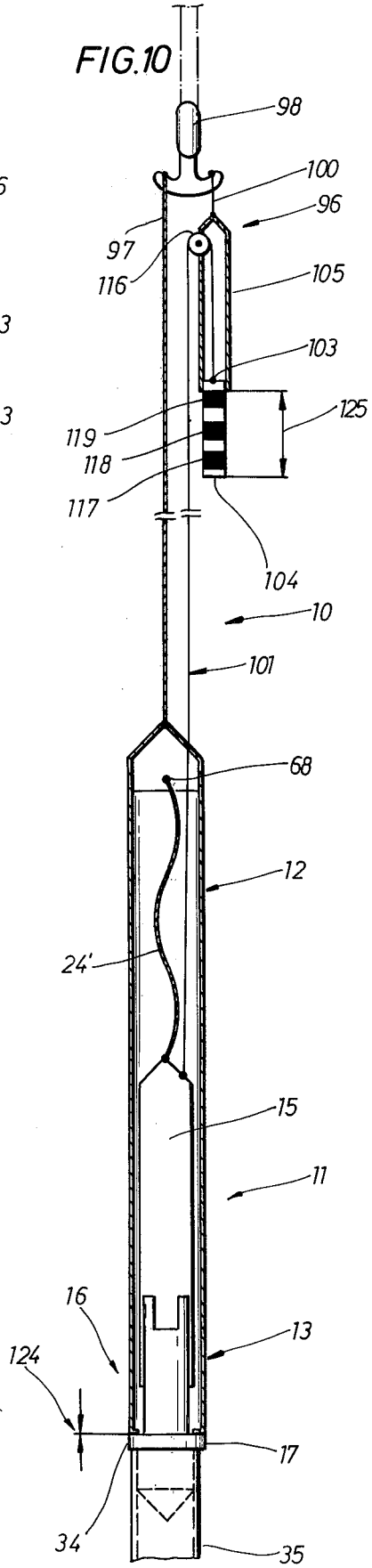

Although the embodiment shown in FIGS. 4 and 5 depict a retaining means 68 which is associated with the lifting bail 28 of casing 15 through the use of an intermediate connection comprised of equalizer plates 73 and components related thereto, it should be readily understood that, the embodiment shown in FIGS. 4 and 5 is preferred. However, were housing 11 to be one continuous, integral housing, retaining means 68 could be utilized with a single connector means comprised of at least one cable having its upper end attached to equalizer plate 69 and its lower end attached to the lifting bail 28 of casing 15 could be utilized as schematically shown in FIGS. 8–10 to be hereinafter described. Similarly, if in the event only one cable were to be utilized as the connector means, that cable could be attached directly to shaft 70, whereupon shaft 70 would serve as retaining means 68, or equalizer plate 69.

As shown in FIG. 4, lower housing 20 is telescopically received within upper housing 19, insofar as the upper end 86 of lower housing 20 has a diameter which is less than the diameter of the lower end of upper housing 19, whereupon lower housing 20 may be telescopically received within the larger lower end of upper housing 19. The lower end of upper housing 19 may be provided with suitable shims 87 which serve to guide and stabilize the reduced diameter portion 86 of the upper end of lower housing 10, as well as provide a suitable wear surface, as it is telescopically received within upper housing 19. Of course, it should be readily apparent that this telescopic connection means could be reversed whereby the upper housing 19 is telescopically received within the lower housing 20.

The telescopic connection means 21 further comprises a receptacle 89 fixedly secured within upper housing 19, whereby a portion, or upper end 86 of lower housing 20 and brackets 76 are guiding received within receptacle 89. In the preferred embodiment receptacle 89 has a rectangular configuration which is open at its top and bottom and is fixedly secured to upper housing 19 by a plurality of braces 90 which are suitably secured to the interior of upper housing 19, such as by welding. Receptacle 89 also serves to guide cables 24 and equalizer plates 73 into alignment with brackets 76 associated with lower housing 20. Receptacle 89 is preferably provided with a flared open bottom 91 whereby lower housing 20 is additionally guided into upper housing 19. Upper housing 19 may also be provided with a key 92 disposed within the interior of upper housing 19, which engages with a corresponding keyway (not shown) disposed along the outer surface of the upper end of lower housing 20.

Receptacle 89 is also provided with at least one, but preferably two, openings 93, or windows, which extend through upper housing 19 and receptacle 89, whereby access is provided to the interior of receptacle 89 to facilitate the insertion of pins 77 to connect upper and lower housings 19 and 20. Additional windows 94 may be provided in upper housing 19 disposed somewhat above receptacle 89 to further enable visual access to the interior of housing 19 and to also provide a vent into the interior of upper housing 19.

As shown in FIG. 5, high pressure air hose 46 is provided with a quick connect and disconnect coupling 95, which is accessable through window 93, whereby hose 46 may be connected prior to commencing pile driving operations.

Figure 6:
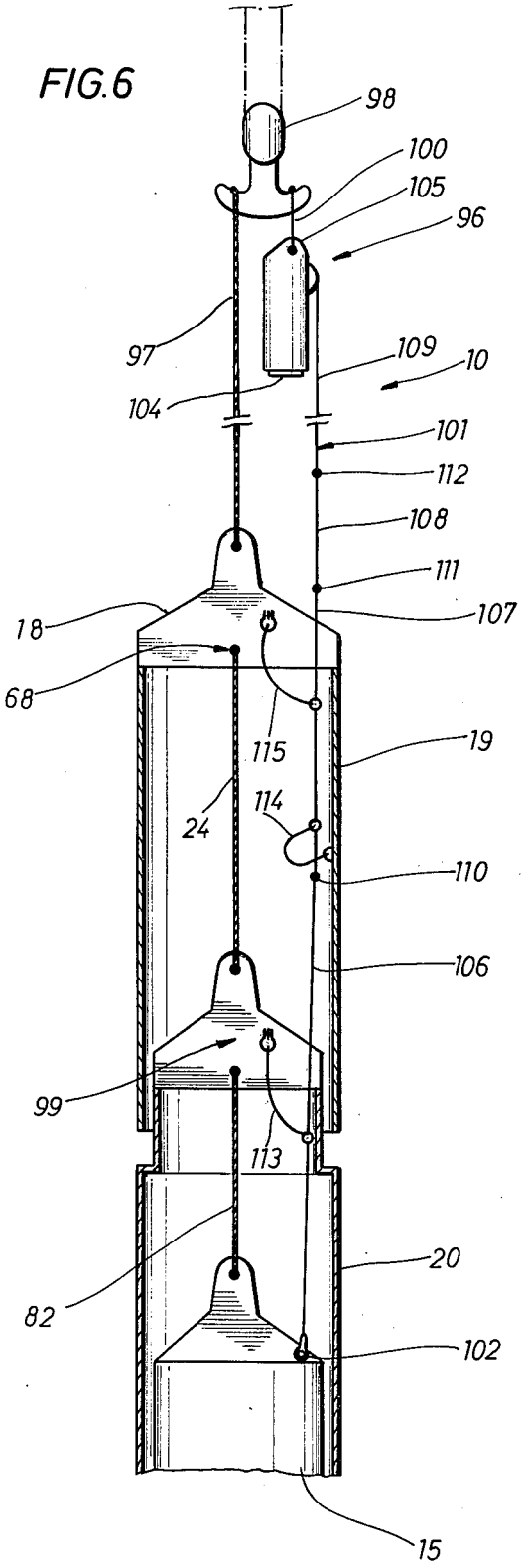
FIGS. 6 and 7 are partial schematic cross sectional views of a pile driving system in accordance with the present invention illustrating the tag line assembly of the present invention.
Figure 7:
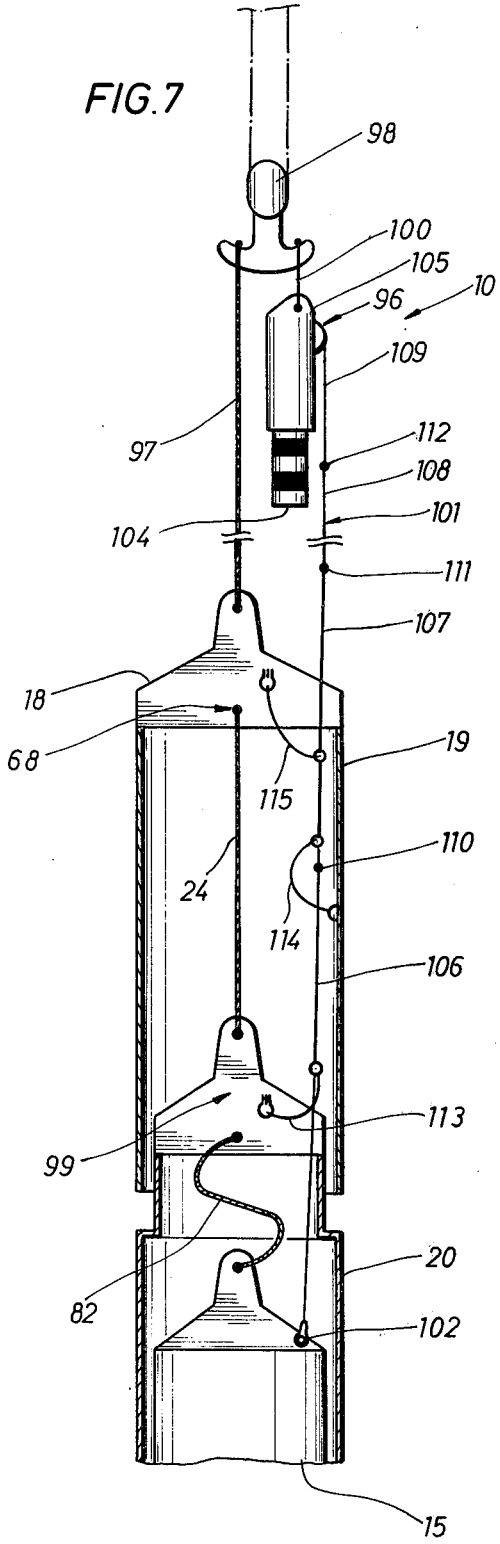

Turning now to FIGS. 6 and 7, the pile driving system 10 of the present invention is schematically shown, including tag line assembly 96. Upper and lower housings 19 and 20 are shown suspended by means of a cable 97 from a crane hook 98. Crane hook 98 is in turn suspended from a crane or winch (not shown) which may be mounted upon either a suitable barge (not shown) or the deck of an offshore structure (not shown).

As shown in FIGS. 6 and 7, lower housing 20 is suspended from upper housing 19 by means of cables 24, and casing 15 is independently suspended within lower housing 20 by means of cables 82. It should be noted that retaining means 68 and the intermediate connection 99 between retaining means 68 and casing 15, which is comprised of equalizer plates 73 and components related thereto, are shown schematically and have been previously described with reference to FIGS. 4 and 5.

Still referring to FIGS. 6 and 7, tag line assembly 96 is shown to be suspended from crane hook 98 by means of cable 100, and comprises a line 101 having a lower end 102 attached to casing 15 and an upper end 103 (as shown in FIGS. 8–10) attached to an indicator bar 104. Indicator bar 104 is slidably received within a sleeve 105. Line 101 may comprise a single continuous line, but preferably is comprised of a plurality of sections 106–109 which are connected by means of any suitable connections 110–112, whereby line 101 may be assembled in sections as pile driving system 10 is assembled. Additionally, a plurality of retrieval lanyards 113–115 may be associated with upper and lower housings 19 and 20 and line 101, whereby the sections 106 and 107 of line 101 may be readily retrieved and grasped during the assembly operation of tag line assembly 96. Retrieval lanyards 113–115 prevent sections 106 and 107 of line 101 from becoming entangled with cables 24 and 82, and provide a means for readily pulling sections 106 and 107 of line 101 from the interior of upper housing 19. It should be pointed out that lanyard 115 is accessible through the open upper portion of housing 19 and lanyards 113 and 114 are accessible via windows 93 and 94 described previously.

Turning now to FIGS. 8–10 the manner in which casing 15 and its associated pile driving hammer assembly 16 are independently suspended within housing 11, and the operation of tag line assembly 96 will be shown in more detail. In FIGS. 8–10 a plurality of cables 24' are utilized to independently suspend casing 15 within housing 11. Additionally, housing 11 is shown to comprise a single elongated housing 11 having an upper and lower portion 12 and 13, as previously described. Accordingly, the means for independently suspending casing 15 within housing 11 is comprised of retainer means 68 (shown schematically) and a connector means, or at least one cable 24', as previously described with respect to FIGS. 4 and 5. Still with reference to FIGS. 8–10, tag line assembly 96 is shown to include a rotatable pulley 116 which is rotatably mounted on sleeve 105. Line 101 is reeved over pulley 116, whereby its upper end 103 may be attached to indicator bar 104 which is slidably received within sleeve 105. Indicator bar 104 further includes a plurality of visible marked graduations 117–119.

FIG. 8 depicts casing 15 and its associated hammer assembly 16 being suspended within housing 11 and extending outwardly through the open bottom 14 of housing 11 its maximum distance as shown by arrows 120. Preferably, the distance shown by arrows 120 is approximately 4½ feet. When pile driving system 11 is in the configuration shown in FIG. 8, cables 24' have no slack in them. In this regard, this configuration corresponds to that shown in FIG. 6, wherein cables 24 and 82 are taut. This configuration of system 11 facilitates a means to calibrate tag line assembly 96, whereby indicator bar 104 is disposed within sleeve 105 such that graduation 117 is not visible to an operator disposed upon the barge or offshore structure. Accordingly, the distance between the bottom of graduation 117 and the bottom of sleeve 105, as shown by arrows 121, is zero. This disposition of indicator bar 104 indicates to an operator on the barge or offshore structure that casing 15 and its associated hammer assembly 16, and in particular driving head 17, are in a fully extended configuration with respect to housing 11. It should be noted that the length of line 101 is adjusted such that to provide this zero distance, or calibration distance, 121 when the pile driving system 11 is in the configuration shown in FIG. 8. It should readily apparent that this adjustment is readily made since the distance from the top of casing 15 to crane hook 98 will be a known quantity, and as housing 11 is lowered under the water, line 101 can be suitably adjusted and calibrated.

As housing 11 is lowered underwater and guided into engagement with the top of pile 35 as previously described, rib 34 on driving head 17 will abut pile 35, thereby stopping casing 15 in its downward movement and causing cables 24' to acquire some slack. The configuration of the pile driving system 10 shown in FIG. 9 corresponds to the configuration of system 10 in FIG. 7, wherein cables 82 have acquired some slack. Accordingly, as housing 11 is continued to be lowered by cable 97, there is relative movement between housing 11 and casing 15 and its associated hammer assembly 16 which has abutted pile 35. As housing 11 moves relative to casing 15 the distance between driving head 17 and the bottom of housing 11 will be decreased to the distance shown by arrows 122. Accordingly, indicator bar 104 will move relative to sleeve 105 a distance shown by arrows 123, which distance will correspond to the distance between driving head 17 and the lower portion 13 of housing 11. Accordingly, graduation 117 and a portion of graduation 118 will be visible to an operator disposed upon a barge or offshore structure. Preferably, the distance shown by arrows 122 and 123 will be approximately 2½ feet and represents a preferred mean driving condition for the pile driving system 10. When the system 10 is in the configuration shown in FIG. 9, casing 15 with its associated pile driving hammer assembly 16 is independently suspended within the lower portion 13 of housing 11, whereby hammer assembly 16 may be engaged with pile 35 and impart a series of blows to pile 35, while housing 11 remains substantially stationary with respect to the underwater surface. Accordingly, rib 34 on driving head 17 will not abut against the lower portion 13 of housing 11, thus avoiding damage to housing 11.

As hammer assembly 16 drives pile 35 into the underwater surface, the slack in cables 24' will diminish until system 11 is in the configuration shown in FIG. 8 and indicator bar 104 would slide inwardly with respect to sleeve 105 and assume the position shown in FIG. 8. Accordingly, as indicator bar 104 slides inwardly with respect to casing 105, the operator of system 10 would lower crane hook 98 until indicator bar 104 has assumed the position shown in FIG. 9, whereby the mean driving condition of system 10 will have been again achieved.

FIG. 10 illustrates an extreme slack condition of system 10, wherein cables 24' as shown in FIG. 10, or cables 82 as shown in FIG. 7, are in a full slack position, such that lower portion 13 of housing 11 abuts with rib 34 of driving head 17. Accordingly, the distance between rib 34 and the lower portion 13 of housing 11 is zero as shown by arrows 124. Accordingly, indicator bar 104 would move outwardly with respect to sleeve 105 to dispose graduations 117–119 visible to the operator thus indicative of a distance shown by arrows 125, which is preferably approximately 4½ feet. If indicator bar 104 becomes disposed as shown in FIG. 10, the operator would immediately cease operation of hammer assembly 16 and raise housing 11 via crane hook 98, in order to prevent driving head 17 from rebounding from pile 35, after hammer assembly 16 has caused it to impart a blow to pile 35, whereby driving head 17 will not strike housing 11 and cause damage thereto.

The foregoing description of the invention has been directed in primary part to a particular preferred embodiment in accordance with the requirements of the Patent Statutes and for purposes of explanation and illustration. It will be apparent, however, to those skilled in this art that many modifications and changes in the specific apparatus utilized may be made without departing from the scope and spirit of the invention. For example, the elongated housing of the present invention could include an upper housing, a lower housing and an intermediate housing, which are suitably connected and have a casing with an associated hammer assembly disposed within the lower housing.

It is applicants' intention in the following claims to cover such modifications and variations as fall within the true spirit and scope of the invention.

What is claimed is:

1. A pile driving system for driving piles into an underwater surface comprising:

a pile driving hammer assembly which includes a ram, and a portion of said hammer assembly adapted for engagement with a pile which is to be driven into the underwater surface;

an elongated casing having the pile driving hammer assembly disposed therein, with said ram in sliding engagement with the casing; and an elongated housing having an upper and a lower portion, wherein the elongated casing is suspended within the lower portion of said housing in sliding engagement therewith for movement with respect to the housing along a path parallel to the longitudinal axis of said housing, and said housing including means for suspending the housing underwater.

2. The pile driving system of claim 1 wherein the portion of the hammer assembly which is adapted to engage the pile, extends through and beyond the lower portion of said housing.

3. The pile driving system of claim 2 wherein the portion of the hammer assembly, which is adapted to engage the pile, is a driving head and said driving head includes means for operatively connecting it to another portion of the hammer assembly and includes shock absorber means.

4. The pile driving system of claim 1 wherein said pile driving hammer assembly comprises:

said ram, which includes a lower section, slidably disposed within the casing and moveable along a reciprocating path parallel to the longitudinal axis of the casing;

an anvil disposed within the casing and having an upper portion and a lower portion, said upper portion adapted for operative engagement with said ram, and said lower portion is operatively connected to a driving head adapted for engagement with a pile to be driven into the underwater surface; and a power source associated with said anvil for causing the ram to move along said reciprocating path into operative engagement with the upper portion of the anvil whereby a plurality of blows may be imparted to the driving head.

5. The pile driving system of claim 4 wherein said power source is an airgun which is disposed within the anvil and is adapted to provide a first blow to the lower portion of the anvil and then cause the ram to move along its reciprocating path, whereby a second blow may be imparted to the upper portion of the anvil.

6. The pile driving system of claim 4 wherein the operative connection between the lower portion of the anvil and the pile follower includes shock absorber means.

7. The pile driving system of claim 6 wherein the operative connection is comprised of a plurality of bolts which pass through the lower portion of the anvil and extend into the driving head; and the shock absorber means is comprised of a body of resilient material which is spaced apart from said anvil, disposed about said bolts, and in contact with the driving head.

8. The pile driving system of claim 5 wherein a sleeve is mounted within the casing, said sleeve having its outer surface fixedly secured to the interior of the casing and has its inner surface in sliding contact with the upper portion of the anvil and the lower section of the ram; said sleeve adapted to guide the ram into operative engagement with the upper portion of the anvil and to assist the upper portion of the anvil in confining the air, discharged from said air gun, between the upper portion of said anvil and the lower section of said ram.

9. The pile driving system of 8 wherein a shock absorber means is disposed between the sleeve and the upper portion of said anvil.

10. The pile driving system of claim 9 wherein said shock absorber means is comprised of a plurality of resilient compression rings disposed about the outer surface of the upper portion of the anvil.

11. The pile driving system of claim 1 wherein the housing includes means for independently suspending the casing and its associated pile driving hammer assembly within the lower portion of said housing whereby the hammer assembly may be engaged with a pile and impart a series of blows to said pile while the housing remains substantially stationary with respect to the underwater surface.

12. The pile driving system of claim 11 wherein the means for independently suspending the casing comprises a retaining means fixedly associated with said housing and a connector means disposed between said retaining means and the casing.

13. The pile driving system of claim 12 wherein said retaining means comprises at least one equalizer plate fixedly secured within the housing, and said connector means comprises at least one cable having an upper end attached to said equalizer plate and a lower end attached to the casing.

14. The pile driving system of claim 11 wherein the upper portion of the housing comprises an upper housing and the lower portion comprises a lower housing, and one of said housings includes a telescopic connection means whereby one of said housings is telescopically received within the other housing.

15. The pile driving system of claim 14 wherein the lower housing is telescopically received within the upper housing.

16. The pile driving system of claim 14 wherein said upper housing includes means for suspending the lower housing comprising at least one cable, having an upper end attached to said upper housing and a lower end attached to the lower housing; and the means for independently suspending the casing within the lower portion of said lower housing comprises a retaining means fixedly secured to the lower housing and a connector means disposed between said retaining means and the casing.

17. The pile driving system of claim 16 wherein said retaining means comprises at least one equalizer plate fixedly associated with the lower housing, and said connector means comprises at least one cable having an upper end associated with said equalizer plate and a lower end attached to the casing.

18. The pile driving system of claim 15 wherein the telescopic connection means comprises a receptacle fixedly secured within said upper housing, a portion of said lower housing being guidingly received within said receptacle, and at least one opening extending through said upper housing and said receptacle whereby access is provided to the interior of said receptacle to facilitate connecting the upper and lower housings.

19. The pile driving system of claim 11 including locating means for indicating the position of the casing relative to the housing.

20. The pile driving system of claim 19 wherein said locating means includes a tag line assembly comprised of a line having a lower end attached to said casing and an upper end attached to an indicator bar which is slidably received within a sleeve, whereby as the housing moves relative to the casing, said indicator bar will move relative to said sleeve to indicate the position of the casing relative to the housing.

* * * * *